US008534107B2

(12) United States Patent
Golovashchenko

(10) Patent No.: US 8,534,107 B2
(45) Date of Patent: Sep. 17, 2013

(54) METHOD AND APPARATUS FOR PULSED FORMING, PUNCHING AND TRIMMING OF TUBULAR MEMBERS

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 259 days.

(21) Appl. No.: 13/157,376

(22) Filed: Jun. 10, 2011

(65) Prior Publication Data

US 2012/0312060 A1 Dec. 13, 2012

(51) Int. Cl.

| | |
|---|---|
| ***B21D 26/00*** | (2006.01) |
| ***B21J 5/04*** | (2006.01) |
| *C06B 21/00* | (2006.01) |

(52) U.S. Cl.

USPC ..... 72/61; 72/58; 72/370.06; 72/370.22; 29/421.1

(58) Field of Classification Search

USPC ..... 72/54, 55, 56, 61, 62, 370.06, 370.22, 72/370.24, 430, 706; 29/421.1

See application file for complete search history.

(56) References Cited

U.S. PATENT DOCUMENTS

| | | | | | |
|---|---|---|---|---|---|
| 3,535,901 | A * | 10/1970 | Tominaga | ..... | 72/61 |
| 3,566,648 | A * | 3/1971 | Norin et al. | ..... | 72/56 |
| 3,603,127 | A * | 9/1971 | Seiffert et al. | ..... | 72/56 |
| 3,654,788 | A * | 4/1972 | Kimura | ..... | 72/56 |
| 3,750,441 | A * | 8/1973 | Schneider et al. | ..... | 72/56 |
| 3,786,662 | A * | 1/1974 | Roth | ..... | 72/55 |
| 3,797,294 | A | 3/1974 | Roth | | |
| 3,852,985 | A * | 12/1974 | Haeusler et al. | ..... | 72/56 |
| 6,591,649 | B1 | 7/2003 | Gafri et al. | | |
| 6,708,542 | B1 | 3/2004 | Gafri et al. | | |
| 7,266,982 | B1 | 9/2007 | Guza | | |
| 7,305,860 | B2 * | 12/2007 | Yang et al. | ..... | 72/61 |
| 8,047,036 | B2 * | 11/2011 | Trubert et al. | ..... | 72/56 |
| 8,252,210 | B2 * | 8/2012 | Zak et al. | ..... | 264/3.1 |

* cited by examiner

*Primary Examiner* — David B Jones

(74) *Attorney, Agent, or Firm* — Damian Porcari; Brooks Kushman P.C.

(57) ABSTRACT

A hydro-forming tool is disclosed in which first and second electrohydraulic forming (EHF) electrodes are used to provide a pressure pulse in opposite ends of a tubular pre-form. Alternatively, an accumulator with a rupturable membrane may be provided in opposite ends of a tubular pre-form for hydro-forming the tubular pre-form. A multiple discharge hydro-forming tool is also disclosed in which several pairs of accumulators are provided with selectively rupturable membranes that are ruptured to provide a pressure pulse in opposite ends of a tubular pre-form. The accumulators or EHF electrodes may be sequenced to provide separate pressure pulses that may be coordinated with retraction of a filler plug or shifting of a split ring into their respective retracted positions. A plurality of pressure pulses may be used to form, pierce and trim the tubular pre-form.

16 Claims, 4 Drawing Sheets

METHOD AND APPARATUS FOR PULSED FORMING, PUNCHING AND TRIMMING OF TUBULAR MEMBERS

TECHNICAL FIELD

This disclosure relates to a method and apparatus in which pressurized fluid are used to hydro-form, pierce or trim tubular blanks.

BACKGROUND

Tubular blanks are formed in production processes with pressure pulses that apply static pressure through a fluid in a hydro-forming process. Hydro-forming operations are generally limited to tubes that have a uniform perimeter and are limited to applications that have no corners with small radii. The use of static pressure through a fluid to pierce tubes is difficult because static pressure inside the tube immediately drops after the first hole (or even some portion of the hole) is pierced. Reduction of the static pressure results in partial separation of the offal being pierced. The use of static pressure through a fluid to trim a tube is not a recognized manufacturing process.

Pulsed forming of tubular blanks is known in prior art in the form of:

1) explosive forming, where the explosive is detonated inside the tubular blank;
2) electromagnetic forming, where a conductive insulated coil is positioned inside the tubular blank;
3) electro-hydraulic forming, where electrodes, for example in U.S. Pat. No. 3,566,648, or a disposable wire, for example in U.S. Pat. No. 3,603,127, are positioned inside the tubular blank.

In the majority of pulsed forming operations, the ratio of tube's diameter to its length is relatively large. In other words, the tube is relatively short. One exception to this is disclosed in Applicant's patent application entitled "Method and Tool for Expanding Tubular Members by Electro-hydraulic Forming" S. Golovashchenko, J. Bonnen U.S. patent application Ser. No. 12/563,191.

Generally, in pulsed forming operations the tube is formed in a single pulsed forming operation. Corner filling, hole piercing and trimming of tubes require different levels of pressure to be applied and cannot be performed in a single pulsed operation. If the level of pressure for piercing or trimming is lower than the level of pressure for corner filling, piercing or trimming, then piercing will occur first, and a corner filling operation will become impossible.

SUMMARY

A method of forming a tubular part is disclosed that comprises loading a tubular preform having a first and a second open ends into a hydroforming die and filling the tubular preform with a fluid. A first and second source of pulsed pressure are positioned near the first and second open ends of the tubular preform. The first and second sources of pulsed pressure are actuated to modify the tubular preform.

According to other aspects of the method, the actuating step may be performed in a first instance to hydro-form the tubular member into tight corners of the hydro-forming die. The actuating step may be performed a second time to punch a hole in the tubular member. The actuating step may then be performed a third time to trim the ends of the tubular member. Alternatively, the actuating step may be performed a second time to trim the ends of the tubular member.

The sources of pulsed pressure may be a pair of electro-hydraulic electrodes. Alternatively, the sources of pulsed pressure may be at least one pair of fluid accumulators. The sources of pulsed pressure may be a plurality of pairs of fluid accumulators.

According to another aspect of the disclosure, a pulsed pressure forming tool is provided for forming a part. A hydro-forming die is provided that includes an upper die and a lower die that receive a tubular preform that has a first end and a second end. At least one pair of pulse generators are also provided with a first one of the pulse generators being disposed adjacent a first end of the tubular member and a second one of the pulse generators being disposed adjacent the second end of the tubular member. An actuator actuates each pair of the pulse generators in a predetermined order.

According to other aspects of the disclosure as it relates to the pulsed pressure forming tool, the pair of pulse generators may be actuated simultaneously. The pulsed pressure forming tool may comprise a pair of pulse generators that each comprise an electrode of an electro-hydraulic forming tool. The pulsed pressure forming tool may include electrodes that are discharged repeatedly in a sequence to perform a plurality of operations including forming and cutting the part.

Alternatively, the pulsed pressure forming tool may include at least one pair of pulse generators that comprise fluid pressure accumulators of a hydroforming tool. As a further alternative, the pulsed pressure forming tool may include a plurality of pairs of hydraulic accumulators that are sequentially discharged in pairs to perform a plurality of operations including forming and cutting the part.

The pulsed pressure forming tool may further comprise a die insert that defines an opening in the hydro-forming die that receives a filler plug. The filler plug is selectively moved between a flush position in which the filler plug backs up a wall of the preform and a retracted position in which the filler plug exposes a piercing edge about the opening in the die insert. Actuation of the pulse generator when the piercing edge is exposed to cause the wall of the preform to be pierced at the piercing edge.

The pulsed pressure forming tool may further comprise a collar that defines a ring around an end of the preform. The collar includes a static ring and a movable split ring that is shifted radially outwardly relative to the static ring to expose the preform to an annular trimming edge of the static ring. The split ring is shifted between a flush position in which the split ring backs up a portion of the wall of the preform and a radially outboard position. Actuation of the pulse generator causes when the annular trimming edge is exposed to cause the wall of the preform to be cut against the trimming edge.

According to another aspect of the disclosure, a pulsed pressure forming tool is provided for forming a part. The tool comprises a hydroforming die that includes an upper die and a lower die that receive a tubular preform that has a first end and a second end. A first pair of pulse generators includes a first one of the first pair of pulse generators being disposed adjacent a first end of the tubular member and a second one of the first pair of pulse generators being disposed adjacent the second end of the tubular member. A second pair of pulse generators includes a first one of the second pair of pulse generators being disposed adjacent a first end of the tubular member and a second one of the second pair of pulse generators being disposed adjacent the second end of the tubular member. A third pair of pulse generators includes a first one of the third pair of pulse generators being disposed adjacent a first end of the tubular member and a second one of the third pair of pulse generators being disposed adjacent the second end of the tubular member. The first pair of the pulse generators are actuated to form the tubular member against the hydro-forming die. A die insert defines an opening in the hydro-forming die that receives a filler plug. The filler plug is selectively moved between a flush position in which the filler plug backs up a wall of the preform and a retracted position in which the filler plug exposes a piercing edge about the opening. The actuator actuates the second pair of pulse generators to cause the wall of the preform to be pierced at the piercing edge. A collar defines a ring around an end of the preform, the collar includes a static ring and a movable split ring that is shifted radially outwardly relative to the static ring to expose the preform to an annular trimming edge of the static ring. The split ring is shifted between a flush position in which the split ring backs up a portion of the wall of the preform and a radially outboard position. The actuator actuates the third pair of pulse generators when the annular trimming edge is exposed to cause the wall of the preform to be cut against the trimming edge. The pulse generators are preferably accumulators.

Alternatively, a pulsed pressure forming tool for forming a part is disclosed that includes a hydroforming die that includes an upper die and a lower die that receive a tubular preform that has a first end and a second end. A pair of pulse generators are provided with a first one of the pair of pulse generators being disposed adjacent a first end of the tubular member and a second one of the first pair of pulse generators being disposed adjacent the second end of the tubular member. The pair of pulse generators are initially actuated to form the tubular member against the hydro-forming die. A die insert defines an opening in the hydro-forming die that receives a filler plug that is selectively moved between a flush position in which the filler plug backs up a wall of the preform and a retracted position in which the filler plug exposes a piercing edge about the opening. The actuator actuates the pair of pulse generators to cause the wall of the preform to be pierced at the piercing edge. A collar defines a ring around an end of the preform and has a static ring and a movable split ring that is shifted radially outwardly relative to the static ring to expose the preform to an annular trimming edge of the static ring. The split ring is shifted between a flush position in which the split ring backs up a portion of the wall of the preform and a radially outboard position in which actuation of the actuator actuates the pair of pulse generators to cause the wall of the preform to be cut against the trimming edge. The pulse generators are preferably electro-hydraulic chambers with electrodes that are connected to a high voltage power supply.

Multiple pulse forming, punching and trimming processes are disclosed in which different sequences of operations are possible with a dynamic hydro-forming tool. For example, piercing of holes or trimming can be postponed by introducing moveable punches which support material in the areas of trimming or hole piercing. A plurality of different sources of pulsed pressure can be used with the hydro-forming tool. The pulses may be created sequentially with electrohydraulic discharges in the chambers that are focused inside the tube. Alternatively, a plurality of pressure accumulators may be provided that provide high pressure liquid pulses to the tube that are pumped into the accumulators when the part is loaded and unload from the tool.

The above aspects and other aspects of the disclosure will be apparent in view of the attached drawings and the following detailed description of the illustrated embodiments.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
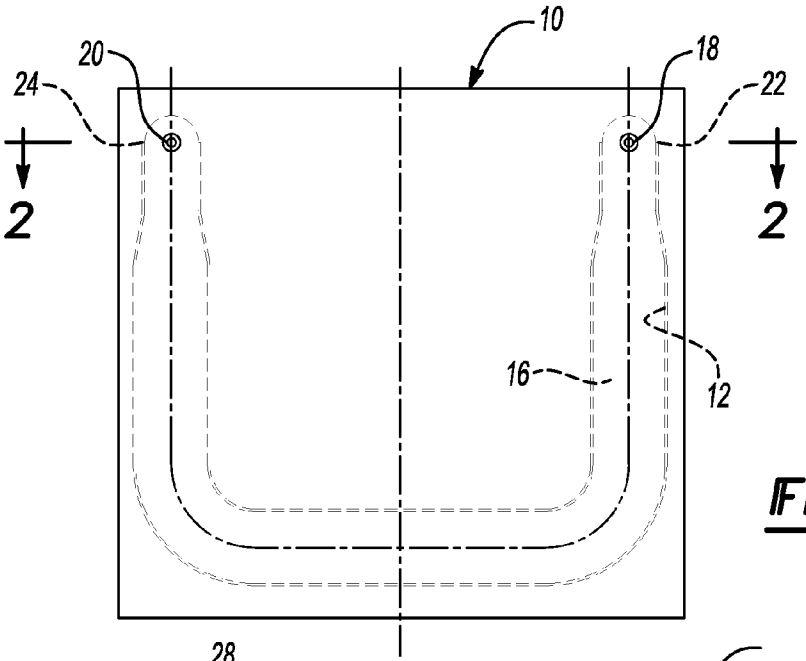
FIG. 1 is a diagrammatic plan view of an electrohydraulic forming tool.

Referring to FIG. 1, a hydro-forming tool 10 is shown with a tubular pre-form 12 disposed in a die cavity 16 defined in the hydro-forming tool 10. A first electrohydraulic forming (EHF) electrode 18 and a second EHF electrode 20 are disposed at a first end 22 and second end 24 of the tubular pre-form 12.

Figure 2:
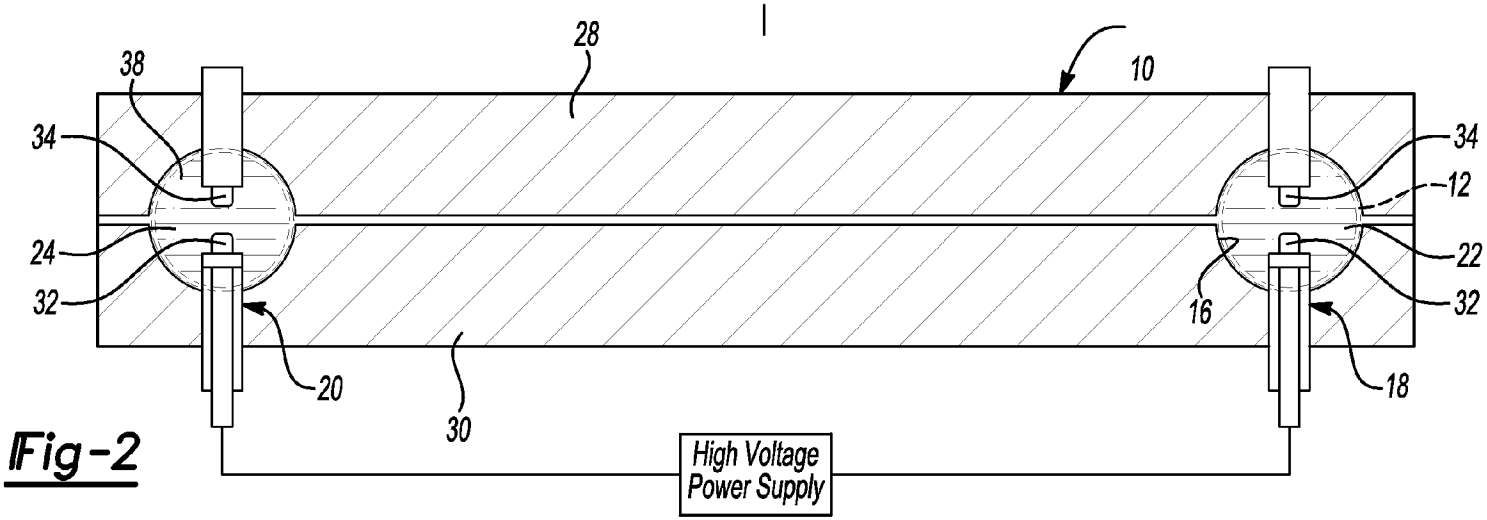
FIG. 2 is a diagrammatic cross-sectional view of the electrohydraulic forming tool taken along the line 2-2 in FIG. 1.

Referring to FIG. 2, the hydro-forming tool 10 is shown to include an upper die 28 and a lower die 30 that are opened and closed to load and unload the tubular pre-form 12. The first and second EHF electrodes 18 and 20 are also shown to include an energized electrode 32 and a grounded electrode 34. When a stored charge is provided to the energized electrodes 32 at the desired voltage level, electricity arcs to the grounded electrodes to create pressure pulses within the fluid 36. The pressure pulses in the fluid are used to form or otherwise act upon the tubular pre-form 12.

Figure 3:
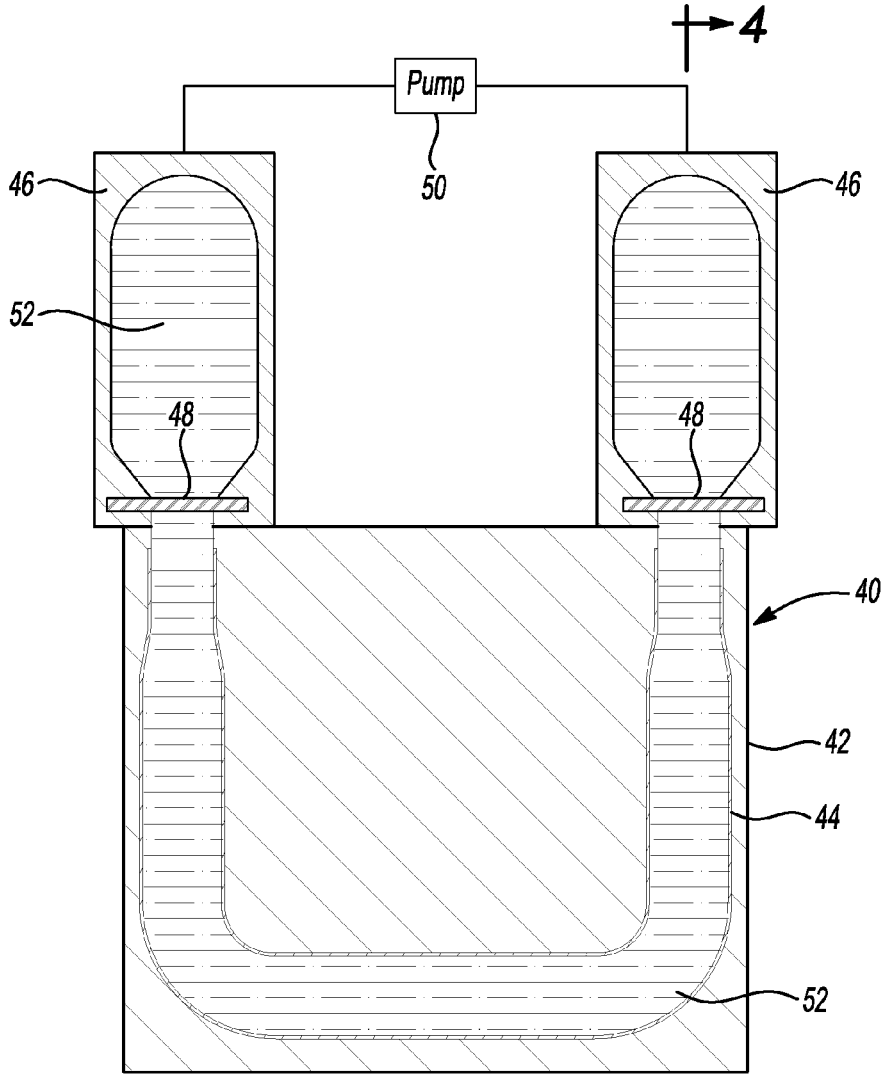
FIG. 3 is a diagrammatic cross-sectional plan view of a hydro-forming tool including a pair of hydraulic pressure accumulators disposed adjacent to opposite ends of a tubular pre-form in a hydro-forming die.

Referring to FIG. 3, a hydro-forming tool is generally indicated by reference numeral 40. A tubular pre-form 42 is disposed in the die cavity 44 defined within the hydro-forming tool 40. A pair of accumulators 46 are provided on opposite ends of the pre-form 42. A rupturable membrane 48 separates the accumulators 46 from the tubular pre-form 42 until a desired level of pressure is developed within the accumulators 46. A pump 50 pumps fluid 52 into the accumulators 46 and also may be used to pump fluid 52 into the tubular pre-form 42.

Figure 4:
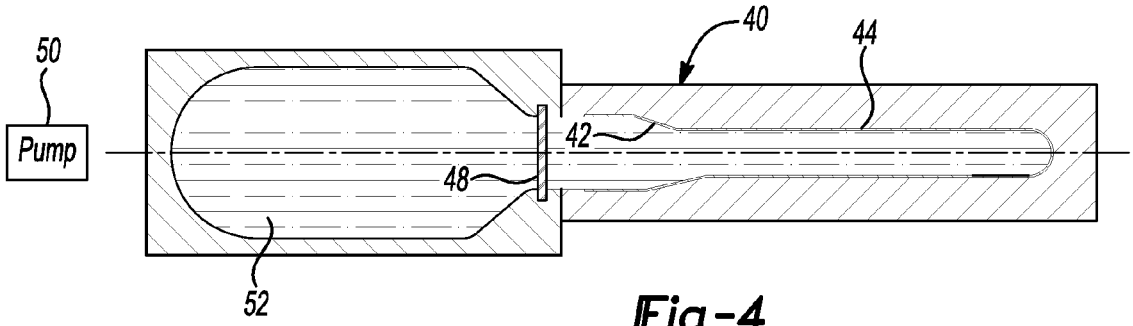
FIG. 4 is a cross-sectional view taken along the line 4-4 in FIG. 3.

Referring to FIG. 4, the hydro-forming tool 40 shown in FIG. 3 is shown in a side cross-sectional view. The tubular pre-form 42 is shown disposed in the die cavity 44. An accumulator 46 having a rupturable membrane 48 is disposed at one end of the tubular pre-form 42. The pump 50 pumps fluid 52 into the accumulators and also into the tubular pre-form 42. When pressure within the accumulator 46 exceeds a predetermined level, the rupturable membrane 48 breaks to provide a pressure pulse that is applied to the tubular pre-form 42 to form the pre-form into a shape of the die cavity 44 that may include corners having small radii.

Figure 5:
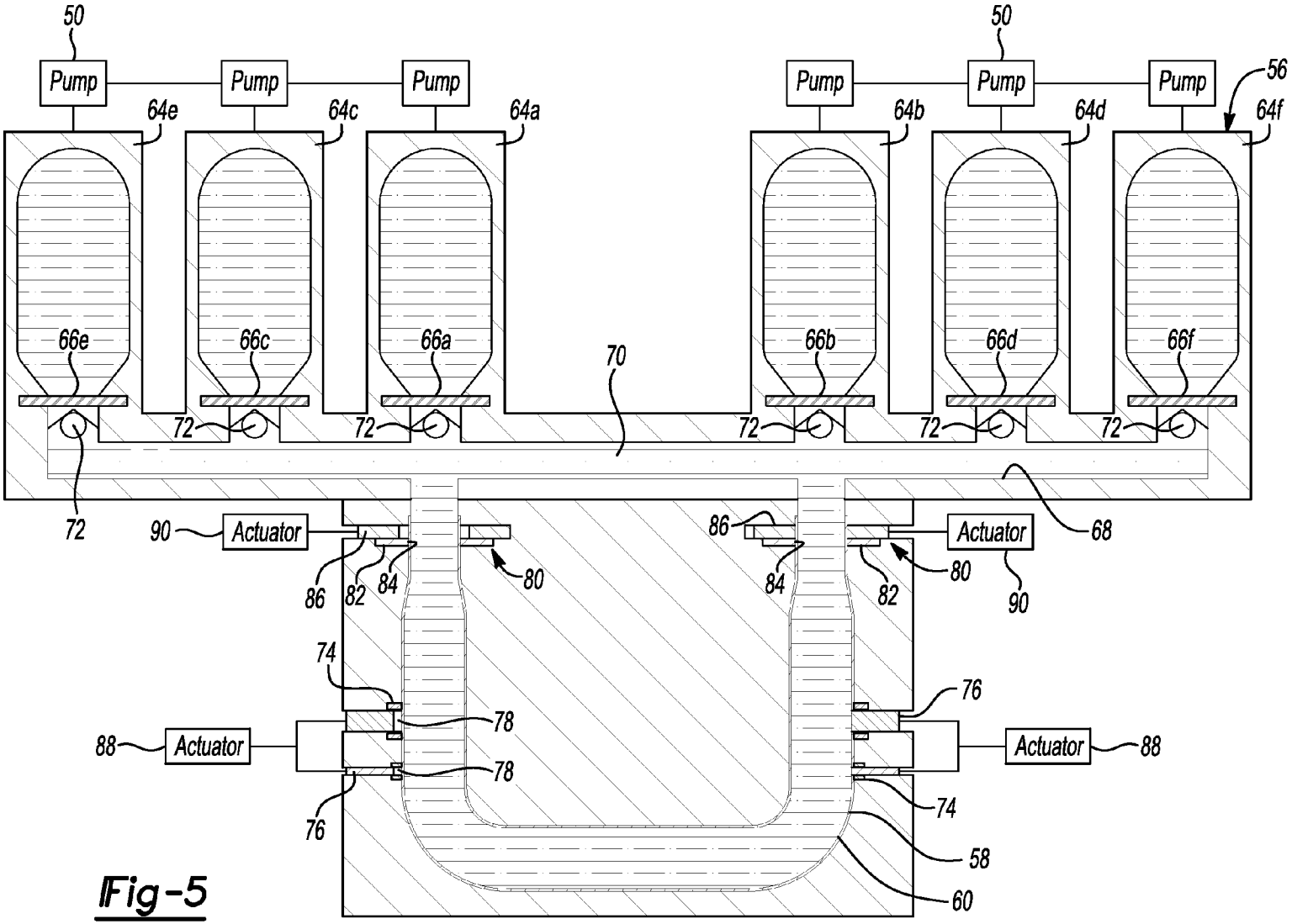
FIG. 5 is a diagrammatic cross-sectional view of a hydro-forming tool having three pairs of accumulators in fluid flow communication with a tubular pre-form disposed in a hydro-forming die to form, pierce and trim the pre-form.

Referring to FIG. 5, a multiple discharge hydro-forming tool 56 is schematically illustrated. A single tubular pre-form 58 is provided in the die cavity 60 defined by the hydro-forming tool 56. Six accumulators 64 *a-f* are shown to include a rupturable membrane 66 *a-f* The rupturable membranes may be calibrated to rupture at different pressure levels within the accumulators 64 *a-f*. Six different pumps 50 are schematically illustrated to be in fluid flow communication with the accumulators 64 *a-f*. A manifold 68 allows for fluid flow communication between each of the accumulators 64 *a-f* and the interior of the tubular pre-form 58 within the die cavity 60. Fluid 70 fills the pre-form and the manifold 68 and is also provided to each of the accumulators 64 *a-f* The accumulators are charged by high displacement pumps 50 that are capable of restoring pressure within the accumulators within a stamping cycle. In order to deliver several pulses following one another sequentially, several accumulators, as shown, are provided with liquid that is compressed to a high pressure. The paired accumulators may release liquid simultaneously from both ends to perform designated operations.

In the embodiment shown in FIG. 5 that includes three pairs of accumulators, one pair of accumulators may be used for corner filling in the tubular member, while a second pair of accumulators may be used for piercing, and a third pair of accumulators may be used to trim the tubular pre-form. A desired sequence of pressure pulses can be followed with pressure being applied by calibrating the ruptured membranes 66 *a-f* to rupture at a designated pressure level. Check valves 72 may be used if a higher level of pressure is applied before a lower level of pressure. The sequence of forming/piercing/trimming is controlled by selectively exposing cutting edges for piercing and trimming operations in conjunction with the timing of the pressure pulses.

Figure 6:
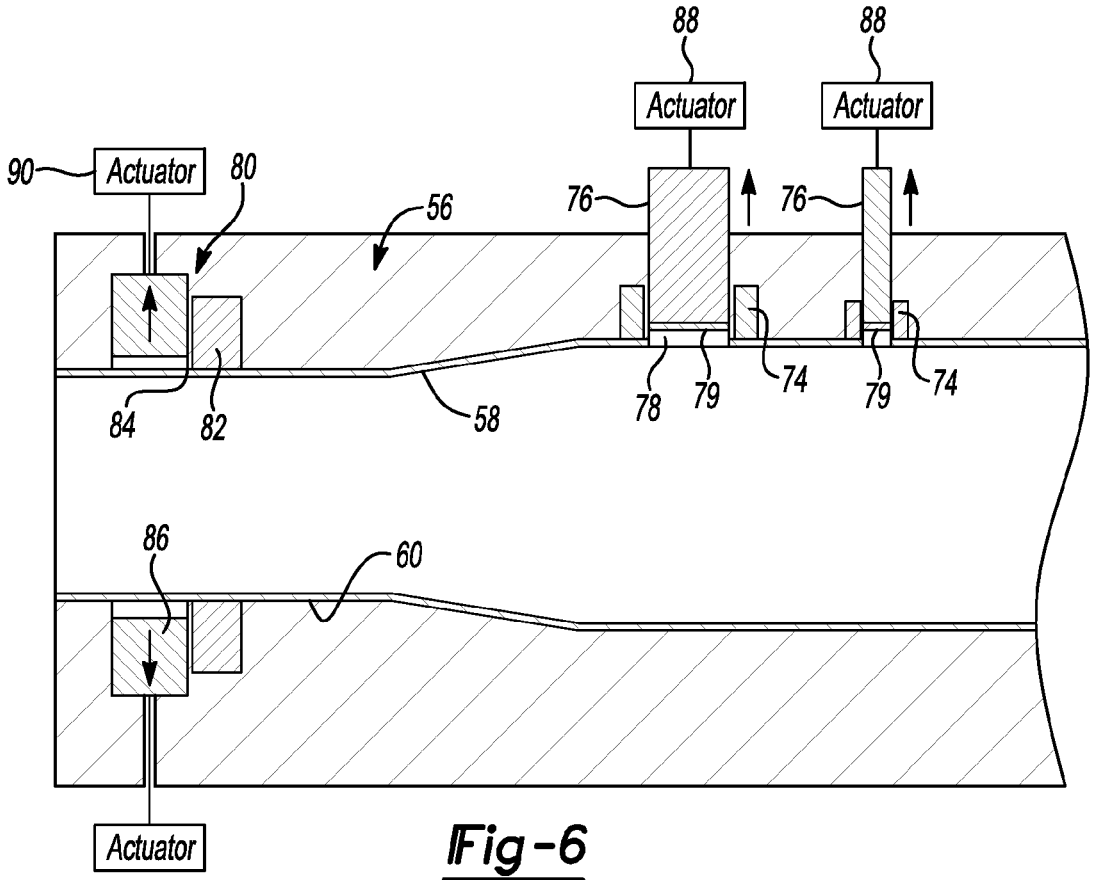
FIG. 6 is a fragmentary cross-sectional view of the trimming and piercing attachments shown in part of a hydro-forming die.
Figure 7:
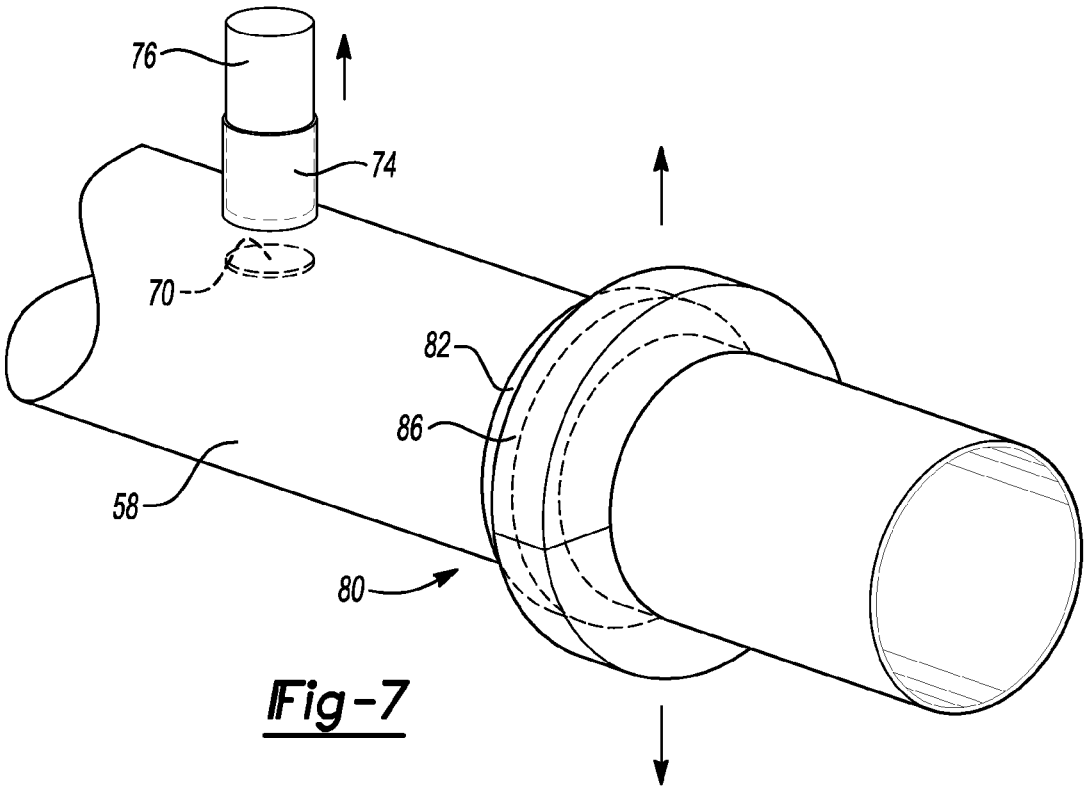
FIG. 7 is a diagrammatic view showing the trimming and punching components adjacent to a tubular pre-form with the other parts of the hydro-forming die not shown.

Referring to FIGS. 5-7, a plurality of die inserts 74 may be provided that operate in conjunction with a filler plug 76 to perform a piercing operation. As shown on the right side of FIG. 5, the filler plugs 76 are in a flush position in which they are flush to the surface of the tubular pre-form 58. On the left side of FIG. 5, the filler plugs 76 are retracted to provide an opening 78 defined by the die inserts 74. A piercing edge is formed about the opening 78. When a pressure pulse is provided inside the tubular pre-form 58 when the filler plug 76 is retracted as shown on the left side of FIG. 5, the pressure applied to the pre-form 58 forces the tubular pre-form into engagement with the piercing edge at the opening 78 defined by the die inserts 74. A slug 79, as shown in FIG. 6, is removed from the pre-form in the area of the opening 78. The slug may be pushed into the die insert 74 temporarily and then ejected by returning the filler plug 76 to the flush position.

A collar assembly 80 may be provided for trimming the end of the tubular pre-form 58, as will be described below. The collar assembly 80 includes a static ring 82 that has a cutting edge 74. A split ring 86 is provided adjacent to the static ring 82. The split ring is shifted between a flush position in which it is flush to the tubular pre-form and a refracted position in which the split ring 86 is shifted radially outwardly to expose the cutting edge 84 of the static ring 82.

One or more actuators 88 may be provided to move the filler plug 76 between the flush position and the retracted position. Similarly, one or more actuators 90 may be provided for shifting the split ring 86 between its flush position and its retracted position. Retraction of the filler plug 76 is coordinated with actuation of one of the pairs of accumulators 64 *a-f* when a hole is pierced in the tubular pre-form 58. Actuator 90 is used to shift the split ring 86 between its flush position and its retracted position and is coordinated with actuation of one of the pairs of accumulators 64 *a-f* by rupturing a pair of the rupturable membranes 66 *a-f* when the split ring 86 is in its retracted position.

Referring to FIG. 7, a tubular pre-form 58 is shown with the die insert 74 and filler plug 76 after a hole is formed in the pre-form 58 by removing a slug 70. Further, a collar assembly 80 is shown in engagement with the tubular pre-form 58. As shown, static ring 82 and split ring 86 are shown with the split ring 86 in its flush position in solid lines. The split ring 86 is shown in its retracted position in phantom lines in FIG. 7. When the split ring 86 is in its retracted position, a cutting edge 84 defined by the static ring 82 may be used to trim the end of the tubular pre-form 58. A pair of accumulators 64 *a-f* are actuated by rupturing a rupturable membrane 66 *a-f* that corresponds to the pair of accumulators that cooperate with the collar assembly 80.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a tubular part comprising:

loading a tubular preform having a first and a second open ends into a hydroforming die;

filling the tubular preform with a fluid;

positioning a first and second source of pulsed pressure near the first and second open ends of the tubular preform; and actuating the first and second sources of pulsed pressure to modify the tubular preform, wherein the actuating step is performed a first time to hydro-form the tubular member into tight corners of the hydro-forming die, and wherein the actuating step is performed a second time to punch a hole in the tubular member.

2. The method of claim 1 wherein the actuating step is performed a third time to trim the ends of the tubular member.

3. The method of claim 1 wherein the actuating step is performed a second time to trim the ends of the tubular member.

4. The method of claim 1 wherein the sources of pulsed pressure are a pair of electro-hydraulic electrodes.

5. The method of claim 1 wherein the sources of pulsed pressure are at least one pair of fluid accumulators.

6. The method of claim 1 wherein the sources of pulsed pressure are a plurality of pairs of fluid accumulators.

7. A pulsed pressure forming tool for forming a part, comprising:

a hydroforming die that includes an upper die and a lower die that receive a tubular preform that has a first end and a second end;

at least one pair of pulse generators with a first one of the pulse generators adjacent a first end of the tubular member and a second one of the pulse generators adjacent the second end of the tubular member; and an actuator that simultaneously actuates each pair of the pulse generators, and wherein the pair of pulse generators each comprise an electrode of an electro-hydraulic forming tool.

8. The pulsed pressure forming tool of claim 7 wherein the electrodes are discharged repeatedly in a sequence to perform a plurality of operations including forming and cutting the part.

9. The pulsed pressure forming tool of claim 7 wherein the at least one pair of pulse generators are fluid pressure accumulators of a hydroforming tool.

10. A pulsed pressure forming tool for forming a part, comprising:

a hydroforming die that includes an upper die and a lower die that receive a tubular preform that has a first end and a second end;

a plurality of fluid pressure accumulators of the pulsed pressure forming tool with a first one of the fluid pressure accumulators adjacent a first end of the tubular member and a second one of the fluid pressure accumulators adjacent the second end of the tubular member; and an actuator that actuates each pair of the fluid pressure accumulators in a predetermined order, wherein a plurality of pairs of fluid pressure accumulators are provided that are sequentially discharged in pairs to perform a plurality of operations including forming and cutting the part.

11. The pulsed pressure forming tool of claim 7 further comprising a die insert that defines an opening in the hydroforming die that receives a filler plug that is selectively moved between a flush position in which the filler plug backs up a wall of the preform and a retracted position in which the filler plug exposes a piercing edge about the opening, wherein actuation of the pulse generator causes the wall of the preform to be pierced at the piercing edge.

12. The pulsed pressure forming tool of claim 7 further comprising a collar that defines a ring around an end of the preform, the collar having a static ring and a movable split ring that is shifted radially outwardly relative to the static ring to expose the preform to an annular trimming edge of the static ring, wherein the split ring is shifted between a flush position in which the split ring backs up a portion of the wall of the preform and a radially outboard position, wherein actuation of the pulse generator causes the wall of the preform to be cut against the trimming edge.

13. A pulsed pressure forming tool for forming a part, comprising:

a hydroforming die that includes an upper die and a lower die that receive a tubular preform that has a first end and a second end;

a first pair of pulse generators with a first one of the first pair of pulse generators being disposed adjacent a first end of the tubular member and a second one of the first pair of pulse generators being disposed adjacent the second end of the tubular member;

a second pair of pulse generators with a first one of the second pair of pulse generators being disposed adjacent a first end of the tubular member and a second one of the second pair of pulse generators being disposed adjacent the second end of the tubular member;

a third pair of pulse generators with a first one of the third pair of pulse generators being disposed adjacent a first end of the tubular member and a second one of the third pair of pulse generators being disposed adjacent the second end of the tubular member;

an actuator that actuates the first pair of the pulse generators to form the tubular member against the hydro-forming die;

a die insert that defines an opening in the hydro-forming die that receives a filler plug that is selectively moved between a flush position in which the filler plug backs up a wall of the preform and a retracted position in which the filler plug exposes a piercing edge about the opening, wherein the actuator actuates the second pair of pulse generators to cause the wall of the preform to be pierced at the piercing edge; and a collar that defines a ring around an end of the preform, the collar having a static ring and a movable split ring that is shifted radially outwardly relative to the static ring to expose the preform to an annular trimming edge of the static ring, wherein the split ring is shifted between a flush position in which the split ring backs up a portion of the wall of the preform and a radially outboard position, wherein the actuator actuates the third pair of pulse generators to cause the wall of the preform to be cut against the trimming edge.

14. The pulsed pressure forming tool of claim 13 wherein the pulse generators are fluid accumulators.

15. A pulsed pressure forming tool for forming a part, comprising:

a hydroforming die that includes an upper die and a lower die that receive a tubular preform that has a first end and a second end;

a pair of pulse generators with a first one of the pair of pulse generators being disposed adjacent a first end of the tubular member and a second one of the first pair of pulse generators being disposed adjacent the second end of the tubular member;

an actuator that actuates the pair of the pulse generators to form the tubular member against the hydro-forming die;

a die insert that defines an opening in the hydro-forming die that receives a filler plug that is selectively moved between a flush position in which the filler plug backs up a wall of the preform and a retracted position in which the filler plug exposes a piercing edge about the opening, wherein the actuator actuates the pair of pulse generators to cause the wall of the preform to be pierced at the piercing edge; and a collar that defines a ring around an end of the preform, the collar having a static ring and a movable split ring that is shifted radially outwardly relative to the static ring to expose the preform to an annular trimming edge of the static ring, wherein the split ring is shifted between a flush position in which the split ring backs up a portion of the wall of the preform and a radially outboard position, wherein the actuator actuates the pair of pulse generators to cause the wall of the preform to be cut against the trimming edge.

16. The pulsed pressure forming tool of claim 13 wherein the pulse generators are electro-hydraulic chambers with electrodes that are connected to a high voltage power supply.

* * * * *